US006296342B1

(12) United States Patent
Oikawa

(10) Patent No.: US 6,296,342 B1
(45) **Date of Patent: *Oct. 2, 2001**

(54) INK JET RECORDING APPARATUS AND A METHOD FOR DISCHARGE RECOVERY THEREOF

(75) Inventor: Masaki Oikawa, Kodaira (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/921,541

(22) Filed: Sep. 2, 1997

(30) Foreign Application Priority Data

Sep. 2, 1996 (JP) ..... 8-250919

(51) Int. Cl.[7] ..... B41J 2/165
(52) U.S. Cl. ..... 347/21; 347/35
(58) Field of Search ..... 347/22, 23, 24, 347/28, 35, 21, 7, 96, 98

(56) References Cited

U.S. PATENT DOCUMENTS

| | | | |
|---|---|---|---|
| 4,417,259 | 11/1983 | Maeda | 347/31 |
| 4,599,627 | 7/1986 | Vollert | 347/20 |
| 4,630,076 | 12/1986 | Yoshimura | 347/43 |
| 5,109,233 | 4/1992 | Nishikawa | 347/12 |
| 5,177,505 | 1/1993 | Sugiura et al. . | |
| 5,270,738 | 12/1993 | Takahashi et al. . | |
| 5,635,969 | 6/1997 | Allen | 347/96 |
| 5,659,342 | 8/1997 | Lund et al. | 347/35 |
| 5,717,443 | 2/1998 | Numata et al. | 347/16 |
| 5,805,182 | 9/1998 | Lee | 347/35 |

FOREIGN PATENT DOCUMENTS

| | | |
|---|---|---|
| 0726158 | 8/1996 | (EP) . |
| 55-139269 | 10/1980 | (JP) . |
| 59-052660 | 3/1984 | (JP) . |
| 3-045814 | 9/1991 | (JP) . |
| 6-040042 | 2/1994 | (JP) . |
| 7-081073 | 3/1995 | (JP) . |

*Primary Examiner*—Robert Beatty
(74) *Attorney, Agent, or Firm*—Fitzpatrick, Cella, Harper & Scinto

(57) ABSTRACT

An ink jet recording apparatus is to record by discharging ink and colorless record processing liquid to a recording medium from ink discharge ports and record processing liquid discharge ports. A detector detects discharge or non-discharge from every discharge port. The discharge recovery process for the processing liquid discharge ports is executed by discharging record processing liquid out of non-discharged ports to the recording medium. With the discharge recovery process thus arranged to be executable on the surface of a recording medium, not only the slowdown of printing speed is prevented, but also, the apparatus main body can be made smaller because there is no need for any provision of receptacle for receiving exhausted processing liquid.

12 Claims, 6 Drawing Sheets

INK JET RECORDING APPARATUS AND A METHOD FOR DISCHARGE RECOVERY THEREOF

BACKGROUND OF THE INVENTION

1. Field of the Invention

The present invention relates to an ink jet recording apparatus that records by discharging ink from recording means to a recording medium. The invention also relates to a method for discharge recovery thereof.

2. Related Background Art

A recording apparatus provided with the functions of printer, copying machine, facsimile, and the like or a recording apparatus, which is used as an output terminal for a complex type electronic equipment or a work station including a computer, a word processor, or the like, is structured to record images (including characters, symbols, or the like) on a recording medium (recording material), such as a paper sheet, a thin plastic sheet, in accordance with recording information. Then, by the recording methods adopted, such recording apparatuses are classified into those of an ink jet type, a wire-dot type, a thermal type, a laser beam type, among some others, respectively.

For a recording apparatus of a serial type where recording is performed, while the main scan is being made in the direction intersecting the carrying direction (sub-scanning direction) of a recording medium, images are recorded (main scanned) by recording means (a recording head) that travels along the recording medium, and when recording on a one-line portion is completed, the recording medium is conveyed in a given amount (a pitch feeding for the sub-scanning). Then, recording is resumed on the recording medium that has come to a stop again. Thus, the images on the next line portion are recorded (main scanned). These operations are repeated to complete recording on the entire area of the recording medium.

On the other hand, for a recording apparatus of a line type where recording is performed only by the sub-scans in the carrying direction of a recording medium, the recording medium is set at a given recording position, and the sheet conveyance (pitch feeding) is made for a given amount, while recording on the one-line portion is being performed altogether and in continuation, thus recording images on the entire area of the recording medium.

Of the recording apparatuses described above, the ink jet type (an ink jet recording apparatus) is such that recording is made by discharging ink from recording means (recording head) to a recording medium, which facilitates making the recording means compact to record images in high precision at high speed, and that recording is made on an ordinary paper sheet without any particular treatment given to it. As a result, its running costs are made lower. Also, being a non-impact type, the ink jet recording apparatus makes a lesser amount of noises when in use. Further, among some other advantages, this apparatus makes it easier to recording color images using ink of multiple colors. Particularly, the line type ink jet recording apparatus using a multiple type recording means, which is provided with a plurality of discharge ports arranged in the width direction of the recording sheet, makes recording executable at a higher speed.

The ink jet type recording means (recording head) that discharges ink by the utilization of thermal energy, in particular, can be produced more easily to provide a highly densified arrangement of liquid flow paths (the arrangement of discharge ports) by forming the electrothermal transducing devices filmed on a substrate, together with electrodes, liquid flow path walls, a ceiling plate, and the like, through semiconductor manufacturing processes such as etching, deposition, sputtering. In this manner, it becomes possible to attempt making the head more compact. On the other hand, however, there have been various demands, in recent years, on the use of recording media (recording materials), such as thin paper, processed paper sheet (such as perforated sheet for filing use, scored sheet, paper sheets of freer configurations) in addition to the paper sheet, thin plastic sheet, and other regular recording media. Further, there have arisen the demands even on the use of cloths or the like.

The ink jet recording apparatus described above is to record by discharging ink from discharge ports formed on the recording head thereof. For such ink jet recording apparatus, finely arranged discharge ports are used. Therefore, if air bubbles or dust particles enter the discharge ports or if the viscosity of ink has increased due to the evaporation of ink solvent, ink becomes unsuitable for discharging or recording any longer (that is, ink discharges are made defective). The ink jet recording apparatus is, therefore, structured to perform discharge recovery processes as means for removing the causes of the discharge defectives by refreshing ink. As a method for executing such discharge recovery processes, a control method is adopted for the discharge recovery by discharging ink from all the discharge ports several times periodically or prior to a recording operation.

Also, in recent years, it is adopted to print (discharge) record processing liquid immediately before printing (recording) in ink (recording liquid) or immediately after having printed (recorded) in ink (recording liquid) in order to record high quality images in particular. A record processing liquid of the kind is colorless transparent processing liquid, and by overlaying the record processing liquid and ink (recording liquid) when printing, these two kinds of liquids are mixed on the recording medium before having been absorbed into such recording medium, thus promoting the fixing of the recorded images on the recording medium.

By means of such method for applying record processing liquid, it is possible to enhance the coloring, water-proofing, bleeding of ink with respect to a recording medium. Particularly, this method demonstrates a significant effect in preventing ink from running due to textures of a recording medium (paper) when using an ordinary paper sheet which is generally in use without any coating that accepts ink or the like. In this way, it is made possible to form images on such recording medium without running of ink. In other words, it has been a problem conventionally that ink (recording liquid) runs because of the texture of an ordinary sheet when the ink jet method is adopted for recording on such sheet which is generally in use for recording. In this respect, now that it has become possible to prevent ink from running by the adoption of such record processing liquid as described above, various kinds of processing liquids are being developed for more suitable uses depending on the properties of ink and recording media of various kinds.

Here, in accordance with the discharge recovery control method of the conventional art described above, it is arranged to make the frequency of discharges for recovery constant and equal per discharge port. As a result, the discharge frequency tends to be much more than the frequency actually needed for the discharge recovery operations required. Thus, ink may be used wastefully in some cases. Also, in accordance with the discharge recovery process of the conventional art, the recording operation (record printing) should be suspended for the discharge recovery operation after shifting the recording head to the discharge recovery position where the ink receptacle is provided for use of the discharge recovery. Consequently, there also arises a problem that such discharge recovery method inevitably brings about the slowdown of printing speed.

Particularly when the record processing liquid is used, the condition that requires the discharge recovery process or the condition that makes discharging unsuitable for recording takes place more often following the evaporation of solvent, because of its higher viscosity than that of ink. As a result, the problem referred to in the preceding paragraph becomes more conspicuous with the adoption of the conventional discharge recovery method described above.

Also, if the discharge recovery operation is performed for the record processing liquid by use of the same ink receptacle used for the ink discharge recovery operation, the record processing liquid and ink are mixed in such receptacle, resulting in the immediate solidification of discarded liquid to make it impossible to remove such solidified liquid from the receptacle. Therefore, a receptacle should be arranged only to receive record processing liquid separately from the one to be used for receiving ink. Then, this arrangement necessitates making the recording apparatus larger inevitably. Also, even if a separate receptacle is arranged to receive the record processing liquid, it is still necessary to discharge the record processing liquid and ink several times simultaneously in a short period of time in a narrow place arranged for the simultaneous operation of such discharge recovery. As a result, a large mount of mist (fine droplets) is generated, and foreign substances are solidified and fixed due to such generation of mist eventually. This is another problem encountered in this respect.

SUMMARY OF THE INVENTION

The present invention is designed with a view to solving the problems encountered in the conventional art described above. One of the objectives of the present invention is to provide an ink jet recording apparatus capable of preventing the slowdown of printing speed by performing the discharge recovery process for record processing liquid, which is usually colorless and transparent on a recording medium during record printing, and also, capable of preventing record processing liquid or ink from being consumed wastefully by controlling to perform discharge recovery processes only for the discharge ports from which no discharge is made during a given period of time. It is an object of the invention to provide a discharge recovery method for such ink jet recording apparatus.

It is another object of the invention to provide an ink jet recording apparatus for recording by discharging ink and record processing liquid to a recording medium from ink discharge ports for discharging ink and record processing liquid discharge ports for discharging record processing liquid, respectively, wherein the discharge recovery process for the processing liquid discharge ports is made executable at least by discharging record processing liquid to the recording medium.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Figure 4:
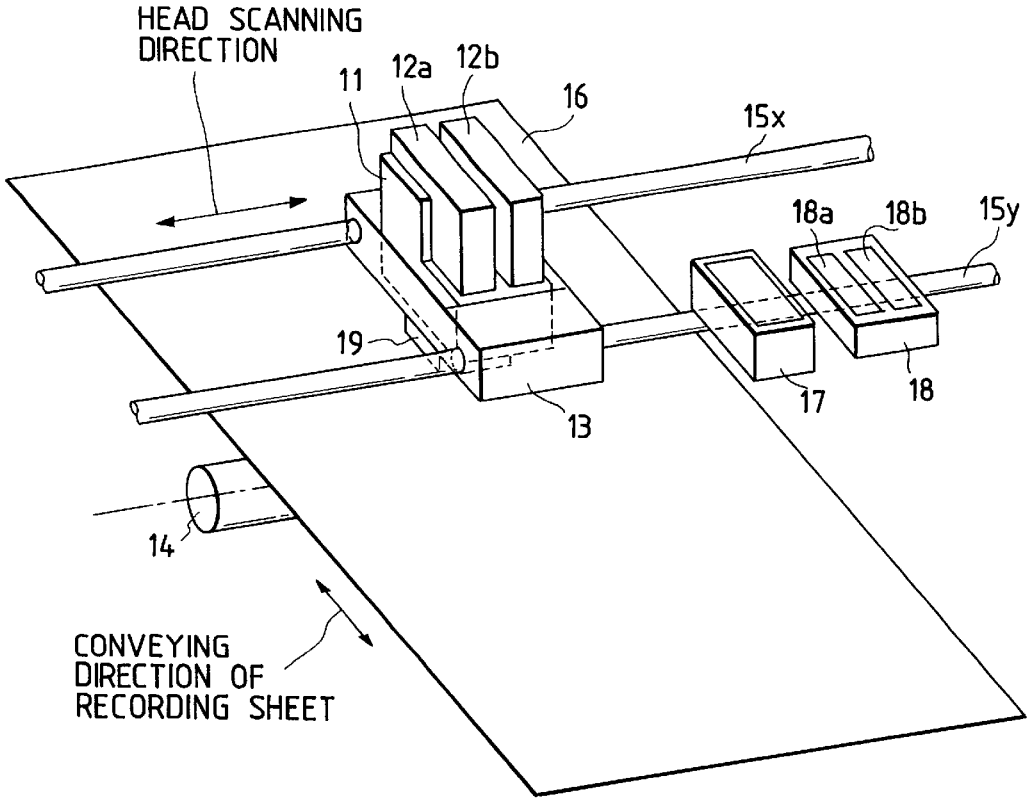
FIG. 4 is a perspective view which schematically shows the structure of principal part in accordance with one embodiment of an ink jet recording apparatus to which the present invention is applicable.

Hereinafter, with reference to the accompanying drawings, the description will be made of the embodiment in accordance with the present invention. FIG. 4 is a perspective view which schematically shows the structure of the principal part of an ink jet recording apparatus to which the present invention is applicable in accordance with one embodiment thereof. In FIG. 4, a reference numeral 11 designates recording means comprising a head cartridge provided with an ink jet recording head unit 19 and an reservoir tank mounted on it. In accordance with the present embodiment, the reservoir tank mounted on the recording means 11 comprises a reservoir tank 12*a* for retaining record processing liquid and a reservoir tank 12*b* for retaining ink. The recording means (head cartridge) 11 is mounted on a carriage 13. The carriage 13 is guided and supported to reciprocate in the head scanning directions (main scan directions) along the guide shafts 15 (15*x* and 15*y*) in FIG. 4.

Figure 5A:
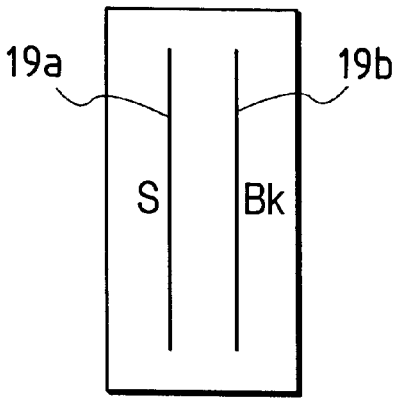
FIGS. 5A and 5B are plan views which schematically illustrate the states of arrangement of discharge port arrays of recording means represented in FIG. 4.
Figure 5B:
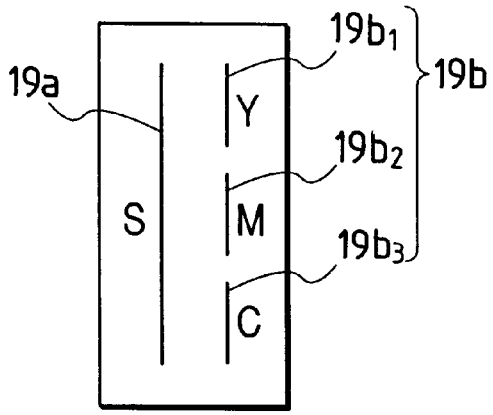

FIGS. 5A and 5B are views which schematically shows the recording head unit 19, observed from the recording medium 16 side (from the bottom side in FIGS. 5A and 5B). The recording means 11 of the present embodiment comprises two head cartridges as shown in FIG. 5A and FIG. 5B, respectively. Two discharge port arrays 19*a* and 19*b* are arranged for each of the head units 19 of the head cartridges. Each discharge port array 19*a* of the head cartridge is to record discharge processing liquid S. Each discharging opening array 19*b* of the head cartridge is to discharge ink (recording liquid).

For the embodiment described in detail as given below, the processing liquid disclosed in the specification of EP-A-726158 is usable as record processing liquid, for example.

The discharge port array 19*b* of the head cartridge shown in FIG. 5A is to discharge black (Bk) ink, while the discharge port array 19*b* shown in FIG. 5B is structured by the discharge port array $19b_1$ to discharge yellow (Y) ink; the array $19b_2$ to discharge magenta (M) ink; and the discharge port array $19b_3$ to discharge cyan (C) ink, which are arranged on one straight line. The two head cartridges a and b can be used exchangeably both for recording documents and color graphics.

In this respect, the recording means 11 of the present embodiment is structured as described earlier, but the structure of recording means is not necessarily limited thereto. For example, it may be possible to arrange the structure so that one head cartridge or three head cartridges or more are made mountable on the carriage 13; head cartridges each having only a discharge port array to discharge one kind of liquid may be used, respectively; or a plurality of discharge port arrays to discharge plural colors may be arranged for each of the head cartridges; or, further, it may be possible to use recording means connected with separate reservoir tanks, supply tubes, and the like.

In FIG. 4, a reference numeral 16 designates a recording medium (recording material) formed by a recording paper sheet or a thin plastic sheet, and 14, a carrier roller that conveys the recording medium 16 in the conveying directions of the recording sheet indicated by arrows in FIG. 4. Recording is performed by discharging record processing liquid or ink to the recording medium 16 from the discharge port arrays 19*a* and 19*b* described above, while recording means (recording head) 11 being caused to travel in the head scanning directions indicated by arrows in FIG. 4 when the carriage 13 is driven. Record printing is executed on the entire area of the recording medium 16 by alternately performing such recording by means of head scans, and conveyances (sub-scans) of the recording medium 16 by means of carrier roller 14.

The liquid discharge portion of the recording head unit 19 described above that discharges record processing liquid and various kinds of ink is arranged to discharge liquid droplets by the utilization of thermal energy. This portion is provided with electro-thermal transducing devices that generate thermal energy. Also, each of the liquid discharge portions is arranged to discharge droplets from each of discharge ports by the utilization of changes in pressure exerted by the development and contraction of each air bubble by means of film boiling brought about by the application of thermal energy thus generated by each of the electrothermal transducing devices described above.

Figure 7:
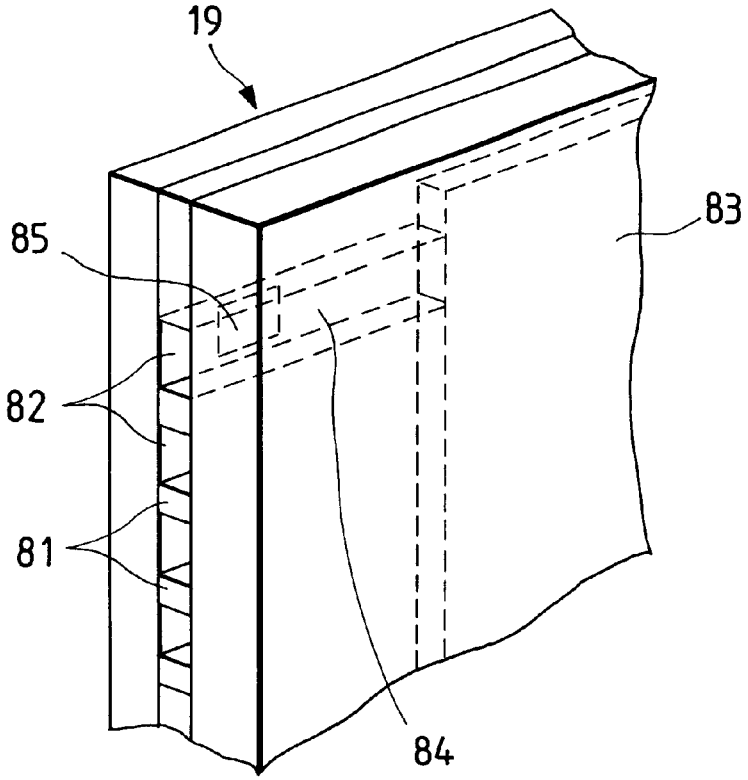
FIG. 7 is a partial perspective view schematically showing the structure of the liquid discharge unit of recording means represented in FIG. 4.

FIG. 7 is a partial perspective view which schematically shows the structure of the liquid discharge portion of the recording head unit 19. In FIG. 7, on the discharge port surface 81 that faces the recording medium 16 at a given gap (approximately 0.5 to 2.0 mm, for example), a plurality of discharge ports 82 are formed at given pitches, and each of the electrothermal transducing devices (heat generating members or the like) 85 is arranged along the wall face of each liquid path 84 that conductively connects the common liquid chamber 83 and each of the discharge ports 82. Recording means 11 is mounted on the carriage 13 in such positional relations that a plurality of discharge ports 82 which constitute each of the discharge port arrays are arranged in the direction intersecting the direction in which the carriage 13 travels (head scanning direction). Then, recording means 11 is arranged to discharge droplets from each of the discharge ports 82 by pressure exerted by film boiling generated in liquid in each of the liquid paths 84 when the corresponding electro-thermal transducing devices 85 are driven (energized) in accordance with discharge signals or recording signals.

In FIG. 4, reference numerals 18*a* and 18*b* designate caps formed by rubber or some other elastic material, which are arranged to face the discharge port surface 81 of the recording head unit 19 in its home position. These caps 18 (18*a* and 18*b*) are supported to be in contact with or to retract from the discharge port surface 81. The caps 18 protect recording means 11 (recording head unit 19) when recording is at rest for transportation or the like, and also, prevent record processing liquid or ink in the vicinity of discharge ports 82 from being evaporated or becoming overly viscous. Further, the caps 18 are used for the suction recovery whereby to compulsorily suck and exhaust record processing liquid or ink from the discharge ports 82 by use of the suction pump.

This suction recovery process is an operation to remove record processing liquid and ink solidified and fixed to the vicinity of the discharge ports 82, as well as the air bubbles that reside in the discharge ports 82 and the common liquid chamber (a space formed in the recording head for retaining ink for its discharge) 83.

In accordance with the present embodiment, the cap portion 18 is divided into two, the cap 18*a* and the cap 18*b*, in order to execute the suction recoveries for the discharge port array 19*a* for record processing liquid and the ink discharge port array 19*b*, because the recording means (head cartridge) adopted therefor is provided with the discharge port array 19*a* for discharging record processing liquid and the discharge port array 19*b* for discharging ink. The reason why the cap portion is divided in such a manner is that the record processing liquid and ink are immediately solidified and fixed if they are mixed, thus making it impossible to remove them.

In FIG. 4, a reference numeral 17 designates an ink exhaust opening for the operation of discharge recovery to be carried out for the ink discharge recovery process. The ink discharge recovery process is the process to compulsorily discharge and exhaust air bubbles, dust particles, the overly viscous ink (that is, ink which is no longer suitable for recording due to the evaporation of solvent or the like), and some other particles residing in the discharge ports 82 to the ink exhaust opening 17 by discharging ink from the discharge port array 19*b*, while the discharge port surface 81 faces the ink exhaust opening 17.

Figure 3:
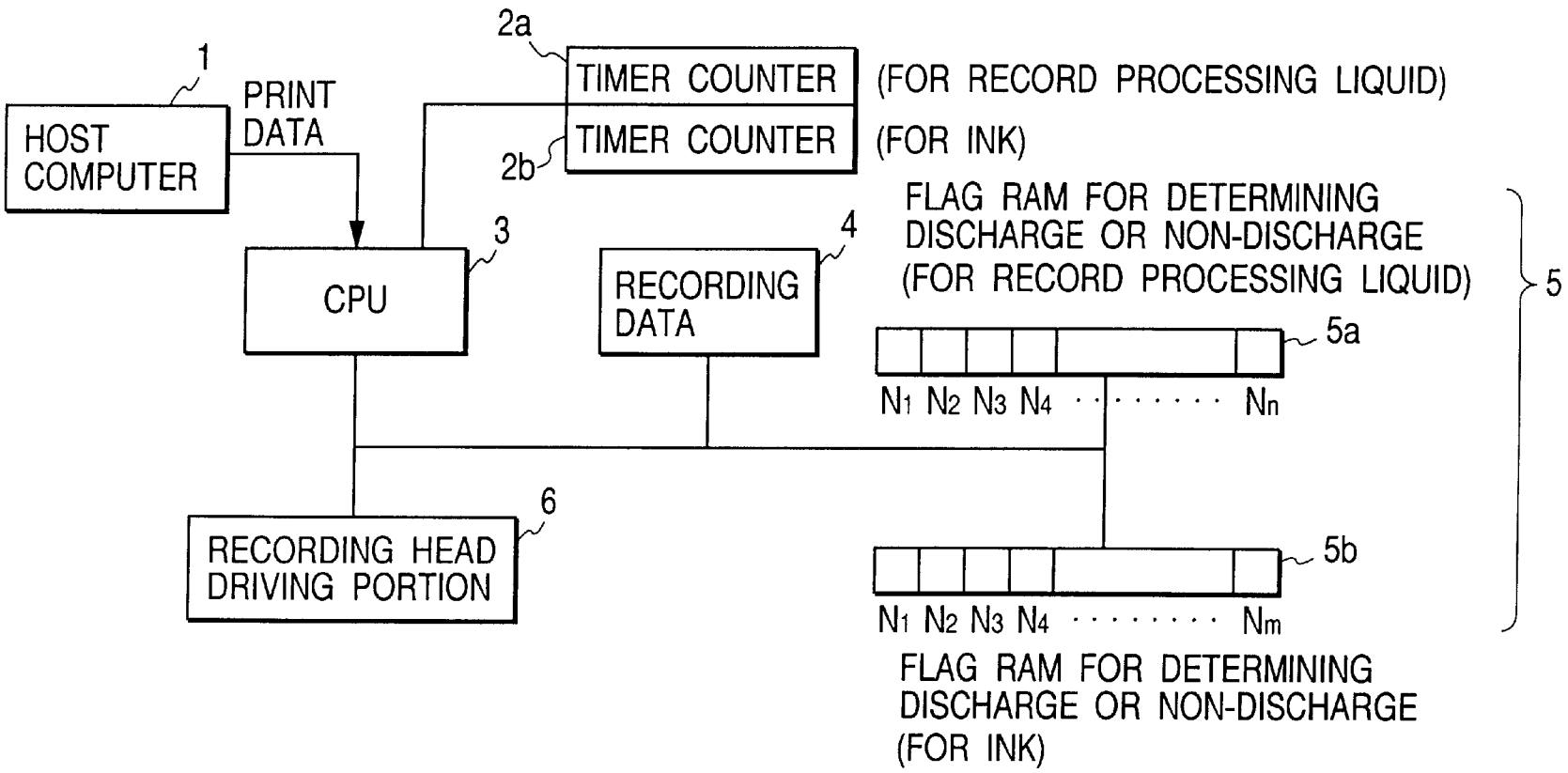
FIG. 3 is a block diagram which shows the structure of principal part of control system in accordance with one embodiment of an ink jet recording apparatus to which the present invention is applicable.

FIG. 3 is a block diagram which shows one structural example of the control system that controls the ink jet recording apparatus represented in FIG. 4. In FIG. 3, a reference numeral 1 designates a host computer that transmits print data to the recording apparatus; 2, a timer counter; 3, a CPU, 4, a record data RAM that stores data to be developed from the print data to those for recording use; 5, a flag RAM for determining discharge or non-discharge that stores flags in order to determine whether any discharge should be present or absent for each of the discharge ports; and 6, a recording head driving portion that causes ink to be discharged by transmitting the developed record data stored on the record data RAM 4 to recording means 11 (recording head) 11. The timer counter 2 comprises a timer counter 2*a* for use of record processing liquid and a timer counter 2*b* for use of ink. The flag RAM 5 for determining discharge or non-discharge also comprises a RAM 5*a* for use of record processing liquid and a RAM 5*b* for use of ink.

Figure 1:
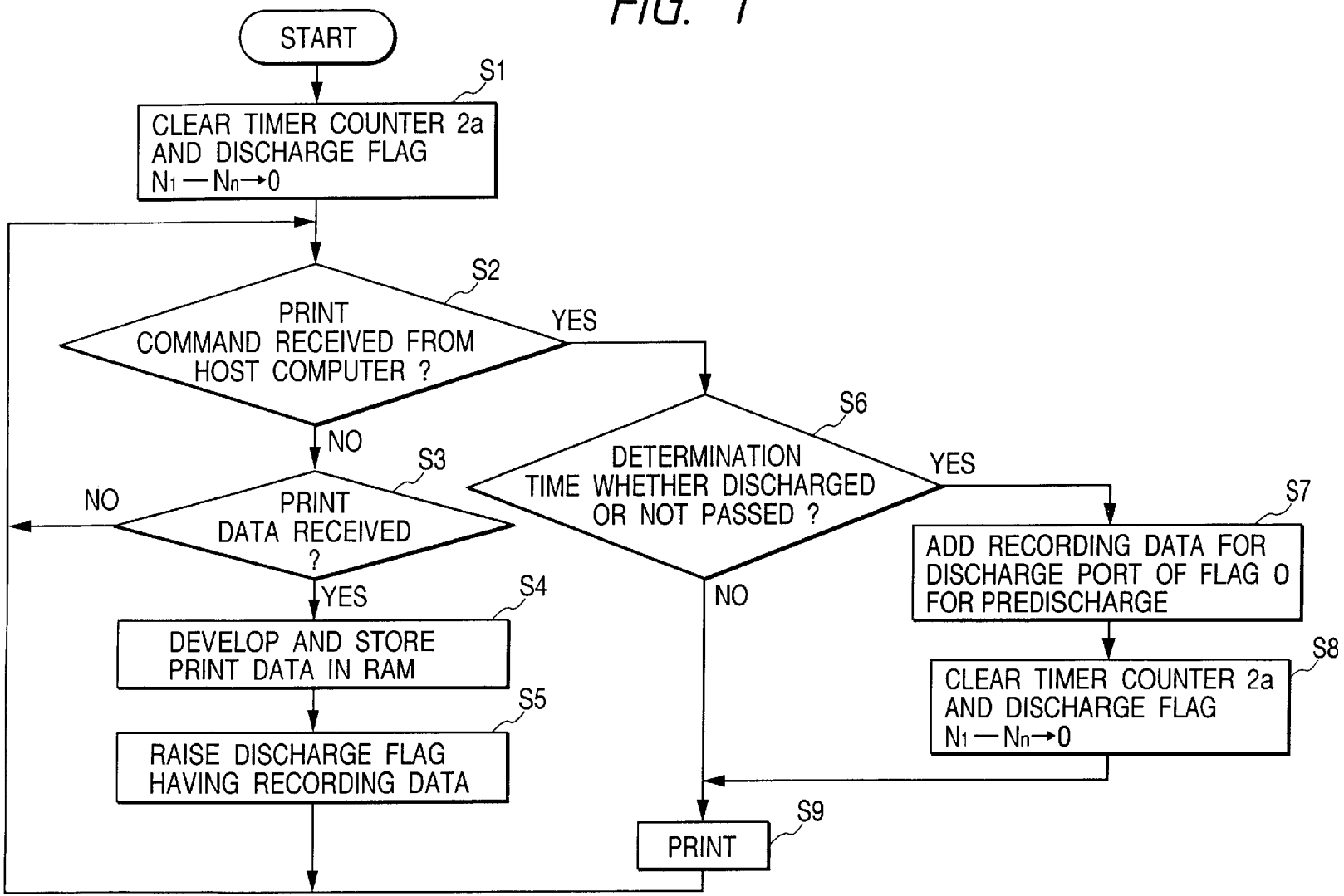
FIG. 1 is a flowchart which shows the control of discharge recovery processes for record processing liquid in accordance with one embodiment of an ink jet recording apparatus to which the present invention is applicable.
Figure 2:
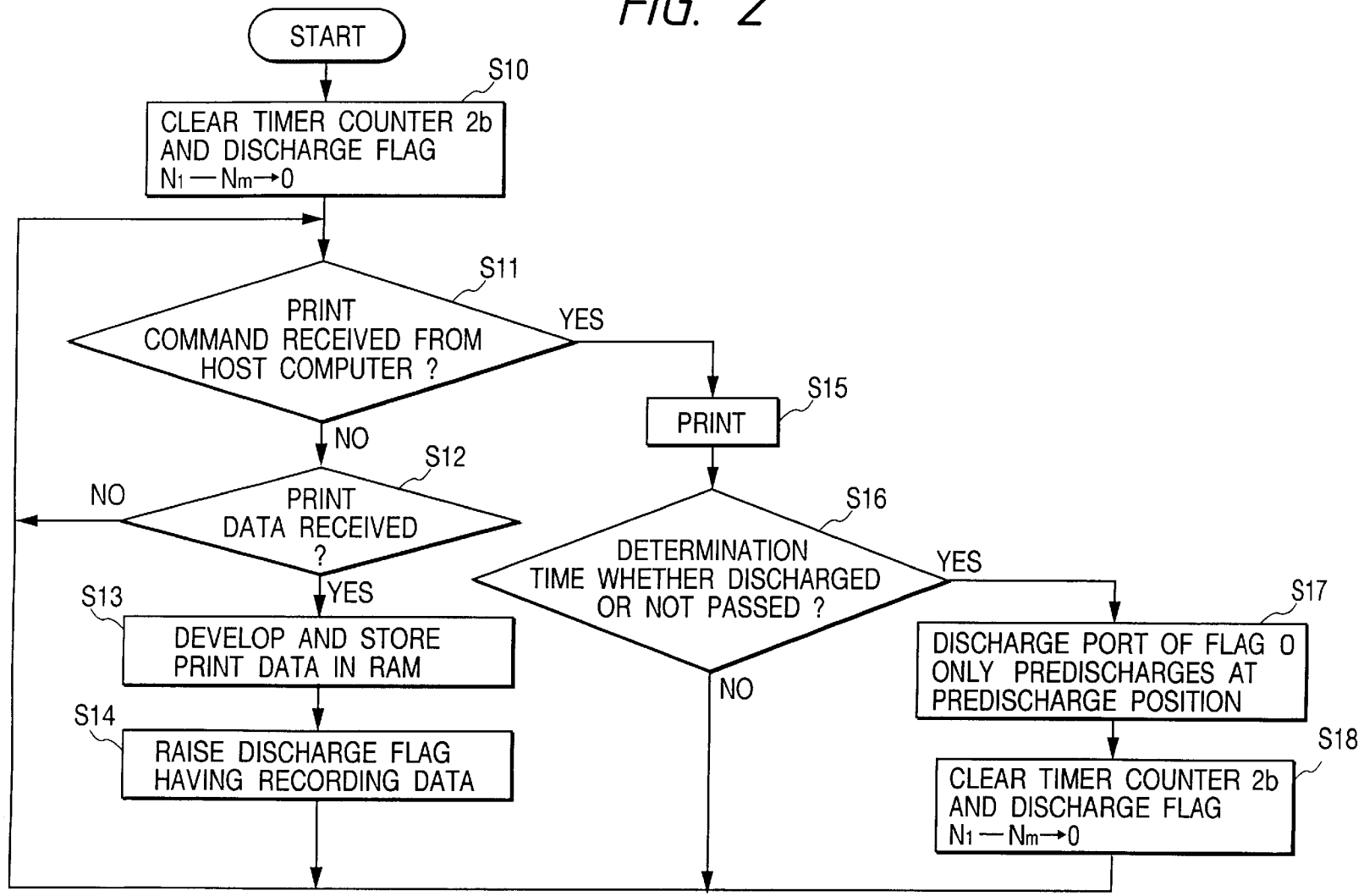
FIG. 2 is a flowchart which shows the control of discharge recovery processes for ink in accordance with one embodiment of an ink jet recording apparatus to which the present invention is applicable.

FIG. 1 is a flowchart which shows the control of discharge recovery process for record processing liquid in accordance with the present embodiment. FIG. 2 is a flowchart which shows the control of discharge recovery process for ink in accordance with the present embodiment. At first, with reference to FIG. 1, the description will be made of the control of discharge recovery of record processing liquid.

In FIG. 1, when this control is actuated in response to the turn-on of the power-supply switch of the apparatus main body, the CPU 3 clears and sets at 0 (step S1) the timer counter 2*a* for use of record processing liquid and flags $N_1$ to $N_n$ (n=the numbers of discharge ports arranged for the recording head to discharge record processing liquid) of the flag RAM 5*a* for determining discharge or non-discharge of record processing liquid.

Then, the decision is made on whether or not any print command is received from the host computer 1 (step S2). If affirmative, it is determined whether or not any print data are received from the host computer 1 (step S3). In the step S3, if print data are present, such print data are developed into the data suitable for recording and stored on the data RAM 4 (step S4). Here, since the data thus stored on the record data RAM 4 have been developed into the discharge data (record data) each for the respective discharge ports, the flag $N_k$ is raised to 1 for the discharge port having such record data therefor with reference to the record data RAM (step S5). Then, the process returns to the step S2. On the other hand, if no print data is received in the step S3, the process returns to the step S2 immediately.

In the step S2, printing begins if a print command is received. However, preceding it, the decision is made (step S6) on whether or not a predetermined time has elapsed for determining discharge or non-discharge by a comparison with the value of the timer counter 2*a* for use of record processing liquid. If such time has not elapsed, the recording data on the record data RAM 4 are transferred to the recording head 11, and then, printing is performed (step S9).

On the other hand, if the time to determine discharge or non-discharge has elapsed in the step S6, the control enters the operation of pre-discharges. Then, with reference to the flag RAM 5 to determine discharge or non-discharge, it is controlled to find any discharge ports having zero flags. If there is found any opening having zero flag, a record data equivalent to a predetermined numbers of pre-discharges is added to the record data on the discharge ports stored on the record data RAM 4 (step S7). Then, as in the step S1, the timer counter 2*a* and the discharge flats are cleared (step S8) for the execution of printing (step S9).

At this juncture, as the record data have been rewritten, the recording data are made different from the print data received from the host computer 1. However, since the record processing liquid is colorless and transparent, it is invisible on the recording medium. Therefore, there is no problem in forming images in this respect. When printing in the step S9 is completed, the process returns to the step S2 to repeat the control described above. Here, in the step S6, it is optimal to set the time $t_1$(seconds) to determine discharge or non-discharge at 5 to 15 seconds when record processing liquid is used. Here, with reference to FIG. 6, the description will be made of the reasons for this setting.

Figure 6:
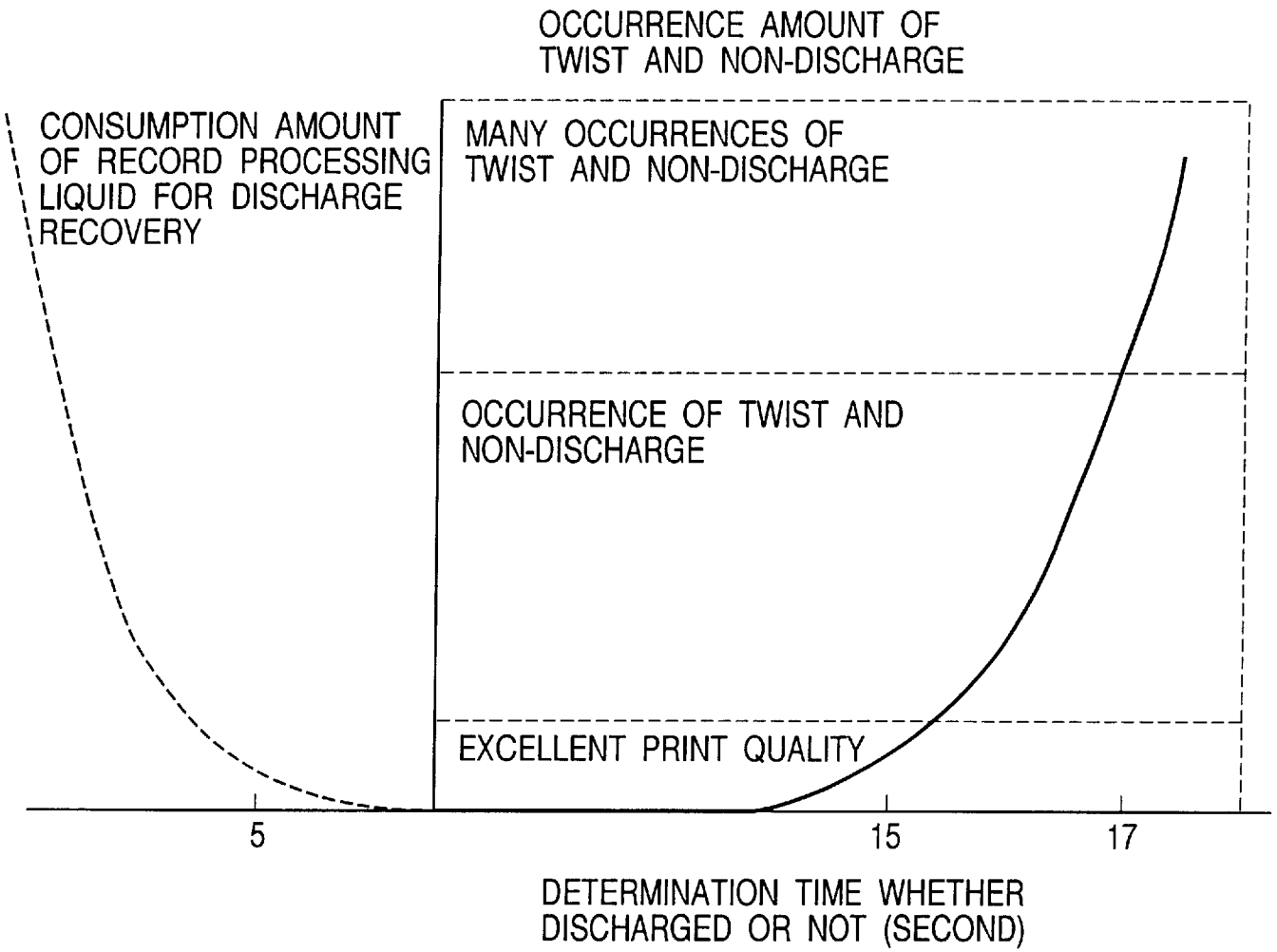
FIG. 6 is a graph which illustrates the occurrence of twisted discharges and non-discharges, and the characteristics of voluminal changes in record processing liquid consumed for discharge recovery for an ink jet recording apparatus with respect to the time set for determining whether or not record processing liquid is discharged.

FIG. 6 is a graph which illustrates the relations between the experimental time (s=second) set for determining discharge or non-discharge, the frequency of occurrence of twisted discharges and non-discharges, and the consumed amount of record processing liquid for discharge recoveries. In FIG. 6, when the time for determining discharge or non-discharge is within approximately 15 seconds, print quality is also excellent, but if the time exceeds it, twisted discharge and non-discharge may take place. At approximately 17 seconds, twisted discharge and non-discharge take place more often. This is because the viscosity of record processing liquid increases following the evaporation of solvent in it. For the discharge port where no discharge is executed for a specific time, the condition of discharge becomes defective, and then, when printing begins, twisted discharge and non-discharge may be caused.

On the other hand, if the time for determining discharge or non-discharge is set at less than five seconds, the operational control should be made more often for discharge recoveries. Therefore, as shown in FIG. 6, the consumed amount of record processing liquid increases remarkably for use of discharge recoveries. Also, this leads to the slowdown of printing speed. With these tendencies in view, it is optimal to set the time for determining discharge or non-discharge at 5 seconds to 15 seconds.

Now, with reference to FIG. 2, the description will be made of the control of ink discharge recovery in accordance with the present embodiment. Here, the control of discharge recovery of record processing liquid and the control of ink discharge recovery are to be executed individually, but are made to be executable in parallel simultaneously. In FIG. 2, when this control is actuated in response to the turn-on of the power-supply switch of the apparatus main body, the CPU 3 clears and sets at 0 (step S10) the timer counter 2*b* for use of record processing liquid and flags $N_1$ to $N_m$ (m=the numbers of discharge ports arranged for the recording head to discharge ink) of the flag RAM 5*b* for determining discharge or non-discharge of ink.

Then, the decision is made on whether or not any print command is received from the host computer 1 (step S11). If affirmative, it is determined whether or not any print data are received from the host computer 1 (step S12). In the step S12, if print data are present, such print data are developed into the data suitable for recording and stored on the data RAM 4 (step S13). Here, since the data thus stored on the record data RAM 4 have been developed into the discharge data (record data) each for the respective discharge ports, the flag $N_k$ is raised to 1 for the discharge port having such record data therefor with reference to the record data RAM 4 (step S14). Then, the process returns to the step S11. On the other hand, if no print data is received in the step S12, the process returns to the step S11 immediately.

In the step S11, printing begins (S15) if a print command is received. Then, the decision is made (step S16) on whether or not a predetermined time has elapsed for determining discharge or non-discharge by a comparison with the value of the timer counter 2*b* for use of ink. If such time has not elapsed, the process returns to the step S11. On the other hand, if the time to determine discharge or non-discharge has elapsed in the step S16, the control enters the operation of pre-discharges. Then, the recording head 11 shifts to the position of the pre-discharge (that is, the position of the ink exhaust opening 17 in FIG. 4). Thus, with reference to the flag RAM 5*b* for determining discharge or non-discharge, it is controlled to find any discharge ports having zero flags. If there is found any opening having zero flag, pre-discharges are executed only for such opening in the predetermined numbers (step S17). When the pre-discharges are completed, the timer counter 2*b* and the discharge flats are cleared (step S18) as in the step S10 in the same manner as in the step S1. Then, the process returns to the step S11.

For the ink pre-discharge operation in the step S17, the recording head 11 should shift to the pre-discharge position (the position of ink exhaust opening 17) for the execution of such pre-discharges. However, as compared with record processing liquid, ink has a lower viscosity. Therefore, the frequency in which ink presents defective discharges or any unsuitable condition for recording is lower than that of record processing liquid. As a result, it is not necessary to execute discharge recovery processes for ink so often. The viscosity of record processing liquid is extremely high, and if the same control should be carried out for discharge recovery of record processing liquid as in the case of ink, it tends to invite a remarkable slowdown of printing speed. At the same time, it tends to consume record processing liquid wastefully.

As described earlier, therefore, it is arranged to control the pre-discharges of record processing liquid and ink individually so that decisions are made individually on the presence and absence of discharge during a specific period of time, respectively, thus executing pre-discharges only for discharge ports from which no discharges have been made for such period of time. Then, as to record processing liquid, the pre-discharges are executed on a recording medium 16 in order to prevent the slowdown of recording speed (printing speed) and the wasteful consumption of record processing more effectively.

As described above, in accordance with the present embodiment, the discharge recovery process of record processing liquid is made on the surface of paper sheet (on a recording medium) during record printing, hence making it possible to prevent the slowdown of printing speed. Also, there is no need for the provision of any receptacle to hold exhausted record processing liquid. Therefore, it becomes possible to attempt making the apparatus main body smaller. Also, there is no need for any simultaneous execution of discharge recovery processes for record processing liquid and ink, thus preventing mist from being generated in a large amount at that time, and preventing it from being solidified and fixed eventually.

Also, with respect to the control of discharge recovery for record processing liquid or ink (recording liquid), the respective decisions are made on the presence and absence of discharges during a specific period of time, and then, the discharge recovery processes are performed only for such discharge ports from which no discharges have been executed. Therefore, any wasteful consumption of record processing liquid or ink can be minimized. Here, record processing liquid is often discharged at a lower frequency, while it has a higher viscosity. Therefore, it is difficult to discharge record processing liquid at a higher frequency even from the viewpoint of design requirements of discharge ports. As a result, it usually takes more time for record processing liquid to execute its discharge recovery process than ink. However, in accordance with the present embodiment, the discharge recovery process (pre-discharge) of record processing liquid can be performed on the surface of recording sheet during record printing. This arrangement makes it possible to eliminate or significantly reduce the loss time that may be caused by the discharge recovery process that should be executed at a lower frequency.

Further, when recording means should shift to the position of discharge recovery processes, there is no need for placing the portion of the discharge port array for record processing liquid outside a recording medium. As a result, the shifting distance of recording means can be shortened to that extent. Thus, the scanning range of recording head can be made narrower to attempt making the apparatus main body smaller accordingly. Also, the discharge recovery processes can be performed individually for recording processing liquid and ink. Therefore, in accordance with the viscosity and other properties of each liquid to be discharged, it is made possible to execute the discharge recovery process appropriately. As a result, more freedom is obtainable in selecting the composition of record processing liquid or ink (recording liquid), as well as in designing the discharge mechanisms for such liquid or ink accordingly.

Here, in accordance with the embodiment described above, recording means (head cartridge) 11 has been described by exemplifying the case where it is of a serial recording type that the head cartridge travels in the head scanning directions. However, the present invention is equally applicable to the line recording type where line type recording means is used to cover the entire width of a recording medium or a part thereof by means of sub-scanning only. The same effects are also obtainable using such type.

Also, the present invention is equally applicable to a recording apparatus using a plurality of recording means, a gradation recording apparatus using a plurality of recording means that record in one and the same color in different densities, or to the case where these recording apparatuses are combined. The same effects are also obtainable using any one of such types.

Further, the present invention is equally applicable to the structure that uses the exchangeable head cartridge in which the recording head and ink tank are integrally formed, to the structure that uses the recording head and ink tank separately provided, but connected by use of ink supply tubes or the like, or to some other structures irrespective of the arrangement of the recording head and ink tank. The same effects are also obtainable using any one of such types.

In this respect, the present invention is applicable to ink jet recording apparatuses. In such cases, it is applicable to recording means using piezoelectric devices or other electromechanical transducing devices, for example. Particularly, however, the present invention demonstrates excellent effects with the adoption of an ink jet recording apparatus that uses recording means of the type where ink is discharged by the utilization of thermal energy. With this type, it is possible to attain recording in high density as well as in high precision.

As clear from the description given above, in accordance with the present invention, an ink jet recording apparatus is structured for recording by discharging ink and record processing liquid to a recording medium from ink discharge ports for discharging ink and record processing liquid discharge ports for discharging record processing liquid, respectively, and then, the discharge recovery process for the processing liquid discharge ports is made executable at least by discharging record processing liquid to the recording medium. Therefore, it is made possible to prevent the slowdown of printing speed, and at the same time, to provide an ink jet recording apparatus capable of being made smaller because there is no need for any provision of receptacle for receiving exhausted record processing liquid. Also, in accordance with the present invention, the discharge recovery process for the ink discharge ports is executed by discharging ink outside the recording medium in addition to the structure arranged as described above, thus making it possible to attain the same effect.

Also, with the structure formed by determination means for determining discharge or non-discharge from each of discharge ports during recording for a predetermined period of time, and control means for controlling to execute discharge recovery process only for the discharge port having non-discharge during recording for the predetermined period of time, it is possible to provide an ink jet recording apparatus capable of preventing the slowdown of printing speed, as well as any wasteful consumptions of record processing liquid and ink, and also, to prevent mist from being generated in a large amount at the time of executing discharge recovery process, as well as its solidification and fixation then.

Also, if the predetermined period of time referred to in the preceding paragraph of time should be made an individual time value respectively for the ink discharge port and for the processing liquid discharge port, it becomes possible to perform the discharge recovery process appropriately for record processing liquid, hence providing an ink jet recording apparatus capable of preventing the slowdown of printing speed, as well as any wasteful consumptions of record processing liquid and ink more effectively, and also, to prevent mist from being generated in a large amount at the time of executing discharge recovery process, as well as its solidification and fixation then.

Also, if the structure is arranged so that the discharge recovery process for processing liquid discharge port is executed during recording in the same driving condition as the one for the recording, it is possible to provide an ink jet recording apparatus capable of preventing the slowdown of printing speed, as well as any wasteful consumptions of record processing liquid and ink, and in addition, being capable of executing the discharge of record processing liquid easily just by rewriting recording data, thus promoting the prevention of slowdown of printing speed still more.

Also, if the structure is arranged so that the predetermined time $t_1$ (seconds) for the processing liquid discharge port is 5 seconds$\leqq t_1 \leqq$15 seconds, it is possible to execute the discharge recovery in an appropriate timing, hence providing an ink jet recording apparatus capable of preventing the slowdown of printing speed, as well as any wasteful consumption of record processing liquid or ink more effectively.

Also, if the structure is formed so that there are arranged determination means for determining discharge or non-discharge from each of discharge ports during recording for a predetermined period of time, and control means for controlling to execute predetermined numbers of discharge only for discharge port having non-discharge during recording for the predetermined period of time, it is possible to provide an ink jet recording apparatus capable of preventing the slowdown of printing speed, as well as any wasteful consumptions of record processing liquid and ink, and also, to prevent mist from being generated in a large amount at the time of executing discharge recovery process, as well as its solidification and fixation then.

Also, if the structure is arranged so that the predetermined numbers of discharge for the processing liquid discharge port, which are referred to in the preceding paragraph, are executed at least on a recording medium, it is possible to provide an ink jet recording apparatus capable of preventing the slowdown of printing speed, and also, capable of making the apparatus main body smaller with the omission of exhaust opening (receptacle of exhausted liquid) for such predetermined numbers of discharge.

Also, if the structure is arranged so that the predetermined numbers of discharge for the processing liquid discharge port, which are referred to in the preceding paragraph, are executed during recording in the same driving condition as the one for the recording, it is possible to provide an ink jet recording apparatus capable of preventing the slowdown of printing speed, as well as any wasteful consumptions of record processing liquid and ink, and in addition, being capable of executing the discharge of record processing liquid easily just by rewriting recording data, thus promoting the prevention of slowdown of printing speed still more.

Also, if the structure is arranged so that the predetermined time $t_1$ (seconds) for the processing liquid discharge port is 5 seconds$\leqq t_1 \leqq$15 seconds, it is possible to execute the discharge recovery in an appropriate timing, hence providing an ink jet recording apparatus capable of preventing the slowdown of printing speed, as well as any wasteful consumption of record processing liquid or ink more effectively.

What is claimed is:

1. An ink jet recording apparatus for recording by discharging ink and record processing liquid to a recording medium, said ink jet recording apparatus comprising:

ink discharge ports for discharging ink;

record processing liquid discharge ports for discharging record processing liquid, the record processing liquid being colorless and transparent;

detection means for detecting discharge or non-discharge at least from every said record processing liquid discharge port during recording for a predetermined period of time; and control means for controlling an execution of a processing liquid discharge recovery process by discharging record processing liquid from only non-discharge ports out of said record processing liquid discharge ports to the recording medium.

2. An ink jet recording apparatus according to claim 1, wherein said ink discharge ports execute an ink discharge discharging ink outside said recording medium.

3. An ink jet recording apparatus according to claim 1 or 2, further comprising:

second detection means for detecting discharge or non-discharge from each of said ink discharge ports during recording for a predetermined period of time, wherein said control means controls the execution of the processing liquid discharge recovery process and the ink discharge recovery process only for each said discharge port determined to have non-discharge during recording for said predetermined period of time.

4. An ink jet recording apparatus according to claim 3, wherein said predetermined period of time is an individual time value for said ink discharge port and for said record processing liquid discharge port, respectively.

5. An ink jet recording apparatus according to claim 3, wherein said processing liquid discharge recovery process is executed during recording in a same driving condition as a driving condition for said recording.

6. An ink jet recording apparatus according to claim 3, wherein said individual time value of said predetermined period of time for said record processing liquid discharge port is a value $t_1$ (seconds) according to the formula: 5 seconds$\leqq t_1 \leqq$15 seconds.

7. An ink jet recording apparatus according to claim 1 or 2, further comprising:

determination means for determining discharge or non-discharge from each of said discharge ports during recording for a predetermined period of time; and control means for controlling to execute predetermined numbers of discharge only for each said discharge port determined to have non-discharge during recording for said predetermined period of time.

8. An ink jet recording apparatus according to claim 7, wherein said predetermined numbers of discharge for said record processing liquid discharge port are executed at least on a recording medium.

9. An ink jet recording apparatus according to claim 7, wherein said predetermined numbers of discharge for said processing liquid discharge port are executed during recording in a same driving condition as a driving condition for said recording.

10. An ink jet recording apparatus according to claim 7, wherein said predetermined period of time for said processing liquid discharge port is a value $t_1$ (seconds) according to the formula: 5 seconds$\leqq t_1 \leqq$15 seconds.

11. An ink jet recording apparatus according to claim 1, further comprising electrothermal transducing devices for generating thermal energy to be utilized for discharging from said discharge ports.

12. A method for recovering discharge ports of an ink jet recording apparatus for recording by discharging ink and record processing liquid to a recording medium from ink discharge ports for discharging ink and record processing liquid discharge ports for discharging record processing liquid, respectively, the record processing liquid being colorless and transparent, said method comprising:

a detection step for detecting discharge or non-discharge at least from every said record processing liquid discharge port during recording for a predetermined period of time; and a processing liquid discharge recovery step for said record processing liquid discharge ports being executed by discharging record processing liquid from only non-discharge ports out of said record processing liquid discharge ports to the recording medium.

* * * * *

UNITED STATES PATENT AND TRADEMARK OFFICE

CERTIFICATE OF CORRECTION

PATENT NO. : 6,296,342 B1
DATED : October 2, 2001
INVENTOR(S) : Masaki Oikawa

It is certified that error appears in the above-identified patent and that said Letters Patent is hereby corrected as shown below:

Column 2,
Line 42, "bleeding" should read -- and bleeding --.

Column 12,
Line 21, "discharge" should read -- discharge recovery process by --.

Signed and Sealed this

Seventh Day of May, 2002

*Attest:*

*Attesting Officer*

JAMES E. ROGAN
*Director of the United States Patent and Trademark Office*